US010633920B2

(12) United States Patent
Lorenson et al.

(10) Patent No.: US 10,633,920 B2
(45) Date of Patent: Apr. 28, 2020

(54) SELECTIVE ACTIVATION OF MOTOR IN A DOWNHOLE ASSEMBLY

(71) Applicant: IMPULSE DOWNHOLE SOLUTIONS LTD., Edmonton (CA)

(72) Inventors: Troy Lorenson, Edmonton (CA); Kevin Leroux, Beaumont (CA); Dwayne Parenteau, Edmonton (CA); Doug Kinsella, Edmonton (CA)

(73) Assignee: IMPULSE DOWNHOLE SOLUTIONS LTD., Edmonton (CA)

( * ) Notice: Subject to any disclaimer, the term of this patent is extended or adjusted under 35 U.S.C. 154(b) by 0 days.

(21) Appl. No.: 15/751,667

(22) PCT Filed: Aug. 12, 2016

(86) PCT No.: PCT/CA2016/050950

§ 371 (c)(1),
(2) Date: Feb. 9, 2018

(87) PCT Pub. No.: WO2017/027964

PCT Pub. Date: Feb. 23, 2017

(65) Prior Publication Data

US 2018/0230750 A1 Aug. 16, 2018

Related U.S. Application Data

(60) Provisional application No. 62/205,655, filed on Aug. 14, 2015.

(51) Int. Cl.
*E21B 4/02* (2006.01)
*E21B 21/12* (2006.01)
(Continued)

(52) U.S. Cl.
CPC ..... *E21B 4/02* (2013.01); *E21B 21/10* (2013.01); *E21B 21/103* (2013.01); *E21B 21/12* (2013.01);
(Continued)

(58) Field of Classification Search
CPC . E21B 4/00; E21B 4/02; E21B 21/103; E21B 21/10; E21B 21/12; E21B 41/0021
See application file for complete search history.

(56) References Cited

U.S. PATENT DOCUMENTS 4,705,117 A * 11/1987 Warren ..... E21B 4/00 175/107
5,535,835 A * 7/1996 Walker ..... E21B 7/067 175/107
(Continued)

*Primary Examiner* — Tara E Schimpf
(74) *Attorney, Agent, or Firm* — Jenna L. Wilson; Wilson Lue LLP

(57) ABSTRACT

A downhole assembly and method are provided for selective activation of a motor in a drilling string. The downhole assembly includes a stator and a rotor assembly. The rotor assembly comprises a rotor body having a fluid passage extending between an inlet and an outlet, the fluid passage extending through at least part of the length of the rotor; and a ball catch component comprising a receiving end and an interior seat for receiving and retaining a blocking implement, and a fluid passage. When no blocking implement is retained in the rotor assembly, the fluid passage permits flow of drilling fluid entering the receiving end to the fluid passage of the rotor body. The fluid thereby bypasses the motor, which is not activated. When a blocking implement is in place, drilling fluid flows around the ball catch component and into the motor to thereby activate the motor.

13 Claims, 7 Drawing Sheets

(51) Int. Cl.

| | |
|---|---|
| ***E21B 21/10*** | (2006.01) |
| *E21B 4/00* | (2006.01) |
| *E21B 41/00* | (2006.01) |
| *E21B 33/12* | (2006.01) |

(52) U.S. Cl.
CPC ..... *E21B 4/00* (2013.01); *E21B 33/12* (2013.01); *E21B 41/0021* (2013.01)

(56) References Cited

U.S. PATENT DOCUMENTS

| | | | | |
|---|---|---|---|---|
| 8,636,073 | B2 | 1/2014 | McNeilly | |
| 9,523,251 | B2 * | 12/2016 | Honekamp | E21B 23/04 |
| 2005/0126828 | A1 * | 6/2005 | Pinol | E21B 4/02 175/92 |
| 2006/0243493 | A1 * | 11/2006 | El-Rayes | E21B 4/02 175/107 |
| 2009/0095528 | A1 * | 4/2009 | Hay | E21B 4/02 175/26 |
| 2014/0199196 | A1 | 7/2014 | Twardowski | |
| 2014/0216761 | A1 | 8/2014 | Trinh | |
| 2015/0136403 | A1 | 5/2015 | Cheng | |

* cited by examiner

SELECTIVE ACTIVATION OF MOTOR IN A DOWNHOLE ASSEMBLY

CROSS-REFERENCE TO RELATED APPLICATIONS

This application claims priority to U.S. Provisional Application No. 62/205,655 filed on Aug. 14, 2015, the entirety of which is incorporated herein by reference.

TECHNICAL FIELD

The present disclosure relates to downhole assemblies utilizing a motor to drive downhole tools, and selective activation of the motor.

TECHNICAL BACKGROUND

When drilling deep bore holes in the earth, sections of the bore hole can cause drag or excess friction which may hinder weight transfer to the drill bit, or cause erratic torque in the drill string. These effects may have the result of slowing down the rate of penetration, creating bore hole deviation issues, or even damaging drill string components.

Friction tools are often used to overcome these problems by vibrating a portion of the drill string to mitigate the effect of friction or hole drag. These friction tools form part of the downhole assembly of the drilling string, and can be driven by the variations in the pressure of drilling fluid (which may be air or liquid, such as drilling mud) flowing through the friction tool. Accordingly, the operation or effectiveness of a friction tool—namely, the frequency of vibrations generated by the friction tool—may be affected by the flow rate of drilling fluid pumped through the string. Controlling the frequency of vibration thus may involve varying the flow rate of the drilling fluid at the surface, and ceasing operation of the friction tool may require cutting off the flow of drilling fluid at the surface. Varying or cutting off the drilling fluid flow, however, may impact the operation of other components in the drilling string.

Furthermore, it is not always desirable to run a friction tool during the entirety of a drilling operation. For instance, it may be unnecessary or undesirable to run the tool while the drill bit is at a shallow depth, or at other stages of the drilling operation where the added vibration of the friction tool is problematic. During those stages, the drill string may be assembled without the friction tool. However, when a location in the bore hole is reached where the need for a friction tool is evident, it is then necessary to pull the downhole assembly to the surface to reassemble the drilling string to include the friction tool, then return the drilling string to the drill point. This process can consume several work hours.

BRIEF DESCRIPTION OF THE DRAWINGS

In drawings which illustrate by way of example only embodiments of the present disclosure, in which like reference numerals describe similar items throughout the various figures.

DETAILED DESCRIPTION OF THE INVENTION

Figure 1:
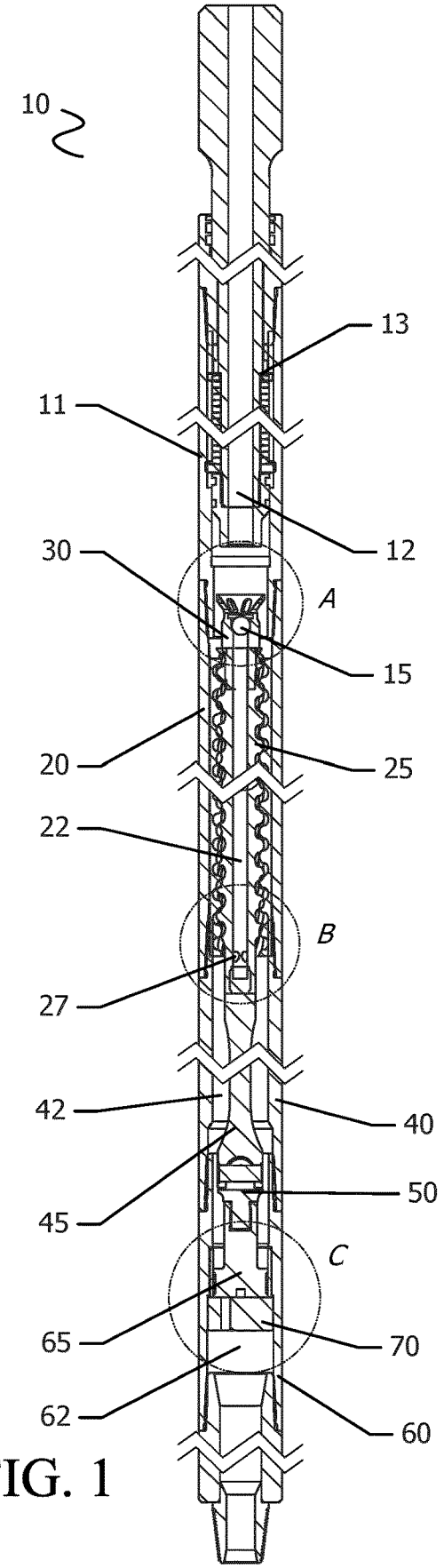
FIG. 1 is a lateral cross-sectional view of a portion of a downhole assembly.

FIG. 1 generally illustrates a lateral cross-section of a portion of an example downhole assembly 10 as it may be assembled within a drilling string for downhole operation. In this example, the exterior of the assembly 10 is defined by interconnected housing components 11, 40, and 60, and the exterior of the stator 20. These components are provided as independent components to facilitate assembly, transport, and repair in the event of failure of an individual component of the assembly 10 and may be connected using appropriate means, such as threaded connections. However, as those skilled in the art will appreciate, in some implementations these housing components 11, 40, and 60 and/or stator 20 may be modified and/or combined without affecting the operation of the inventions described herein. In this particular illustrated example, housing component 11 can house a drilling string component such as an oscillation assembly 13, while housing 40 is a shaft housing, and housing 60 is a valve housing enclosing a valve assembly. As will also be appreciated by those skilled in the art, the particular features of the motor assembly and the valve assembly discussed herein need not be used together to realize the advantages of these features, nor need they be used with the other subs or downhole assembly 10 components or tools mentioned herein.

In the example assembly 10 of FIG. 1, the motor is a Moineau-type motor with a multi-lobe rotor 25 rotating in a multi-lobe stator 20. Appropriate rotor/stator ratios may be selected to drive downhole components according to the desired frequency of operation of the drilling string. In example embodiments, a 6/7 or 7/8 ratio, or a sufficiently high ratio of rotor to stator lobes is employed in order to provide a rotor 25 of sufficiently large cross-sectional area to maximize the size of the bore or passage 22 in the body of the rotor 25, as discussed below. An end of the rotor can be coupled to a driveshaft 45, for instance using a universal joint or other suitable connector, to enable the transmission of torque from the rotor to other components in the assembly 10.

In this particular example, the driveshaft 45 is coupled by another universal joint 50 to a valve assembly including a rotating valve component 65 and a corresponding stationary valve component 70. This valve assembly may be used to activate the oscillation tool 13, for example by varying the flow of drilling fluid and fluid pressure. The oscillation tool 13 can be positioned elsewhere in the downhole assembly 10 sufficiently close to the valve assembly so as to be affected by the variations in fluid pressure. Such a valve assembly includes a rotating flow head 65 and a stationary flow restrictor 70, each with ports that enter into and out of alignment as the flow head rotates against the flow restrictor so as to vary the flow of drilling fluid through the entire valve assembly during operation. Variations of such a flow-varying valve assembly are described in further detail below. As mentioned above, while this valve assembly may operate in concert with the other features of the present motor assembly to be described in further detail below, the motor assembly and the valve assembly can be used independently. In the illustrated embodiment, the downhole assembly 10 can function as a friction tool in the drilling string.

As is generally understood by those skilled in the art, in prior art downhole assemblies employing a similar motor, drilling fluid passes from a bore or passage above the motor (indicated in FIG. 1 at 12) and into the cavities defined between the rotor 25 and stator 20 to thereby activate the motor, and consequently drive any downhole tools coupled to the rotor. Any fluid passing through the motor enters the bore or passage downstream of the rotor (indicted in FIG. 1 at 42). In the particular example of FIG. 1, the drilling fluid then passes through the valve assembly 65, 70 in the valve housing 60, and into the passage 62 downstream of the valve assembly.

The flow of drilling fluid through the motor in part determines the rotation speed and horsepower of the motor, along with the particular lobe configuration of the motor. Thus, once a drilling string is assembled, the rotation speed and power of the motor can be changed only by varying the flow of drilling fluid, or else by retracting the drilling string from the bore hole, disassembling it, and reassembling it with a differently configured motor. However, it may not be desirable to vary the flow rate of the drilling fluid in this manner, and disassembling and reassembling a drilling string can consume several hours of labour.

Accordingly, in the illustrated examples, the motor assembly includes a bypass system which can be selectively activated or deactivated to control the flow of drilling fluid through the motor assembly. This can be better seen in FIG. 2, which provides an enlarged view of the motor assembly portion 100 of the cross-section of FIG. 1. The motor assembly includes the stator 20 and the rotor 25. The rotor 25 is provided with a through bore or passage 22 extending through the entire or a substantial part of the length of the body of the rotor 25. The passage 22, which may be circular in profile, permits fluid communication through a substantial part of the length of the rotor 25 from a first end having an inlet to a second end having an outlet. In this example, when the rotor 25 is in position in a downhole drilling string, the first end is uphole from the second end. The passage 22 can be circular in cross-section, but may have other configurations within the rotor body. At or near the second end of the rotor 25, one or more outlets 27 provide fluid communication from the passage 22 to other parts of the drilling string below. This second end may therefore be referred to as the outlet end. Since the rotor 25 may be connected to other components of the downhole assembly at its second or outlet end (e.g., by the universal joint connected to the driveshaft 45), the outlets 27 may be positioned above this connection.

Figure 2:
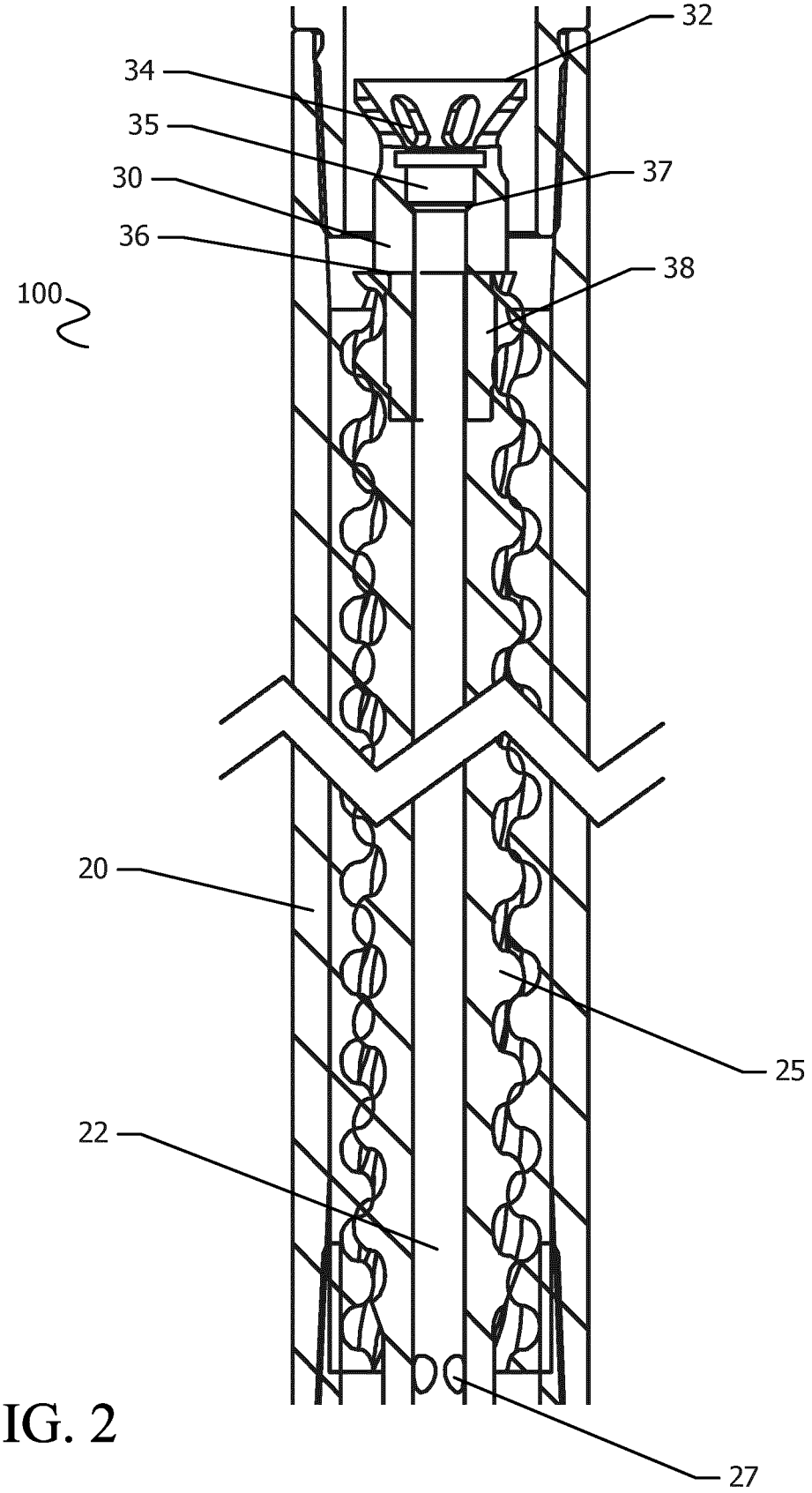
FIG. 2 is a lateral cross-sectional view of a rotor assembly for use in the downhole assembly.

A further component, a catch component 30 is mounted at the first end of the rotor 25. The catch 30 is configured to receive and retain a blocking implement. The blocking implement can be a substantially spherical ball or another shape configured to block passage through the catch 30 and/or rotor 25, as explained below. In the illustrated examples, the catch 30 is an insert mounted to the rotor using appropriate connectors, such as threaded joins; however, the catch 30 can alternatively be mounted using a separate connector element, not shown. In the illustrated examples, the catch 30 is configured to be inserted in the upper end of the rotor 25. As can be seen in FIG. 2, a connection end 38 of the catch 30 is received within an upper portion of the rotor 25. The connection end 38 terminates at an exterior shoulder 36, which is positioned proximate to the upper end of the rotor 25 when the catch 30 is installed in the rotor 25. When the catch 30 is installed, substantially all fluid is blocked from entering the passage 22 from the upper end of the rotor except through the catch 30. Thus, when the catch 30 is in place, fluid can pass into the catch 30, though the passage 22, and out through the one or more outlets 27. While the catch 30 is illustrated here as a distinct component from the rotor 25, in some implementations the catch 30 may be formed in a single piece with the rotor 25.

Figure 3:
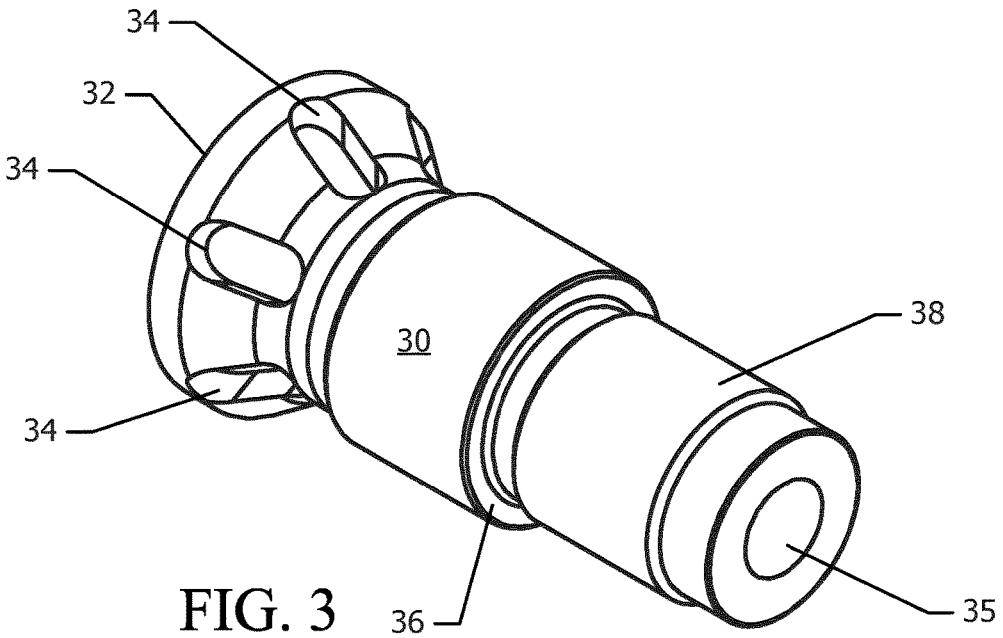
FIGS. 3 and 4 are perspective and lateral cross-sectional views, respectively, of a catch for use in the downhole assembly.
Figure 4:
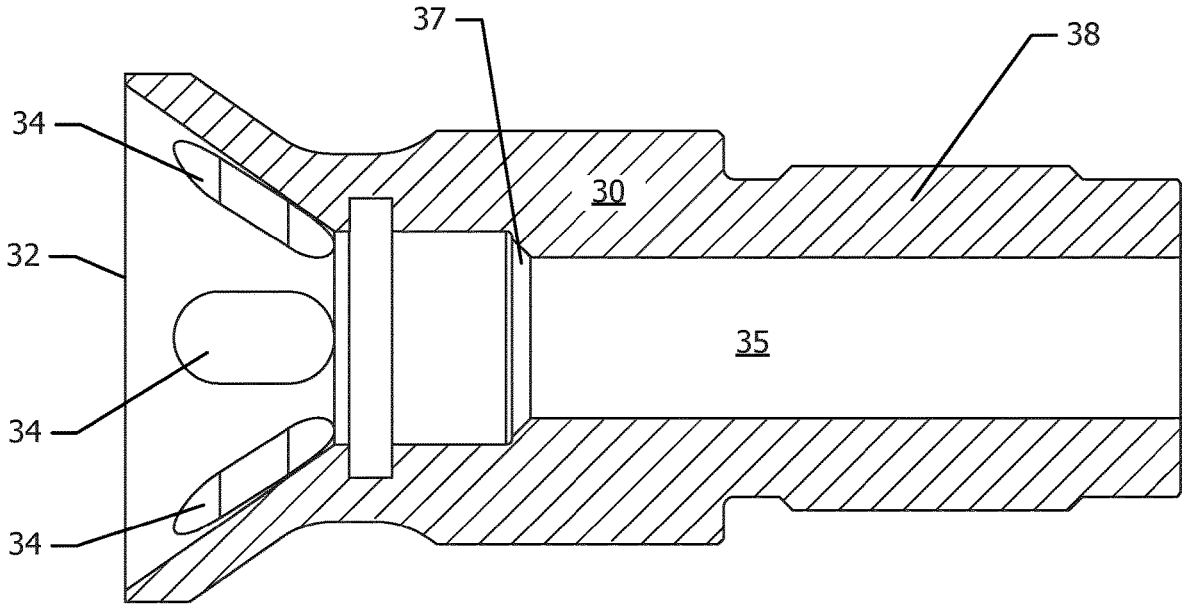

With reference to FIGS. 2-4, the catch 30 includes a receiving end 32, which is sized to fit within the surrounding housing and may have a substantially funnel shape to facilitate catching a blocking implement dropped down the drilling string. There may be sufficient clearance within the housing to permit drilling fluid to pass around the exterior of the receiving end 32 and the catch 30 and down towards cavities defined by the rotor 25 and stator 20 of the motor assembly 100. The receiving end 32 can be provided with slots or apertures 34 that also permit fluid entering the receiving end 32 to pass from the interior of the receiving end 32 to the exterior of the catch 30. Defined within the catch 30 is a bore or passage 35 of varying diameter, as will be discussed below. This passage 35 is in fluid communication with the passage 22 of the rotor when the catch 30 is installed in the rotor 25. Thus, the entire rotor assembly (consisting of an integrated catch and rotor, or an assembled catch and rotor) has a passage 35-22 permitting fluid to pass from the catch's receiving end 32 to the outlets 27 when the catch 30 is not blocked.

Within the catch 30, the diameter of the passage 35 varies from a dimension wide enough to receive a blocking implement, such as a ball 15 (shown in FIG. 1) caught by the receiving end 32 after it is dropped into the drilling string to direct the ball 15 towards an interior of the catch 30 and an interior seat 37, which in this example is an angled interior shoulder restricting the diameter of the passage 35 to a size that is smaller than the diameter of the ball 15. Thus, when the ball 15 is received on the seat 37, it substantially blocks fluid passage into the inlet end of the rotor 25 and through the passage 35 into the passage 22 of the rotor 25. It will be appreciated that by selectively placing a ball 15 on the seat 37, fluid passage through the motor assembly 100 can be controlled to thereby control the rotation and horsepower of the motor assembly 100, with or without varying the flow rate of the drilling fluid at the surface.

Figure 5:
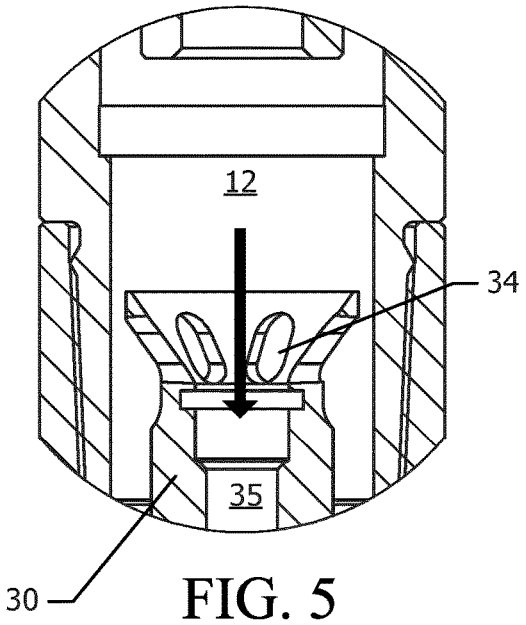
FIGS. 5 and 6 are sectional views of the downhole assembly of FIG. 1 when the catch is in a first state.
Figure 6:
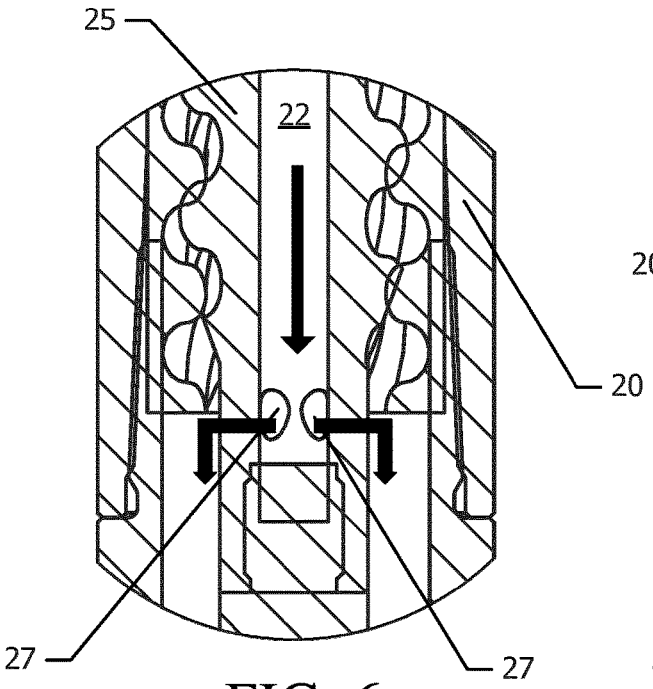
Figure 8:
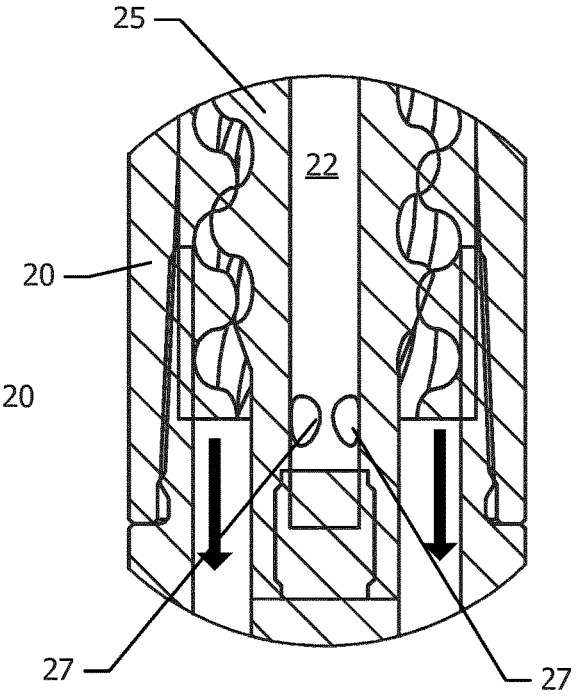

This is illustrated in greater detail in FIGS. 5-8. FIG. 5 is an enlarged view of the section A indicated in FIG. 1. When no ball 15 is seated in the catch 30, the catch 30 is in a non-engaged state. Drilling fluid can pass from the passage 12 in the drilling string above the catch 30 into the passage 35 of the catch 30, and through the passage 22 of rotor 30. All or a substantial amount of the drilling fluid will therefore bypass the cavities of the motor and exit the outlets 27 of the rotor 35, as illustrated in FIG. 6. While a small amount of drilling fluid may pass around the catch 30 or through the apertures 34 to the exterior of the catch 30 and enter the space defined by the rotor and stator of the motor, it may not be sufficient to activate the motor; or, if the motor is nevertheless activated, the torque generated by the motor may be significantly decreased or even substantially nil. Thus, even though drilling fluid is flowing through the downhole assembly, the torque may not be sufficient to activate a downhole component such that it has a significant effect. Thus, when the passage 35 is not blocked, the motor can be considered to be substantially inactive.

Figure 7:
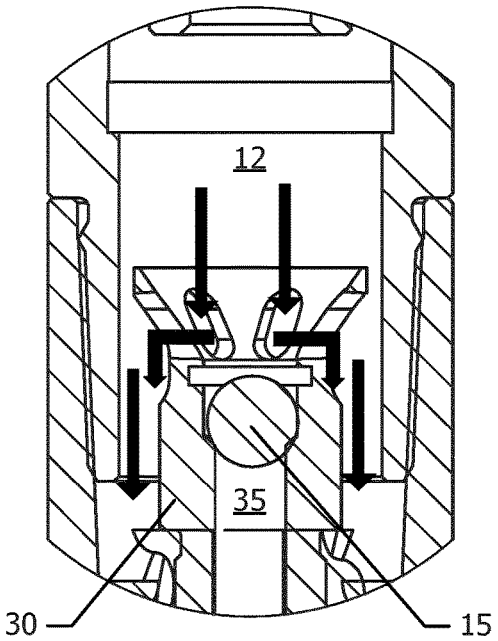
FIGS. 7 and 8 are sectional views of the downhole assembly of FIG. 1 when the catch is in a second state.

When a ball 15 or other blocking implement is dropped into position in the catch 30, as illustrated in FIG. 7, the catch 30 is in an engaged state. Fluid entering the downhole assembly is prevented from entering the passage 35, and is redirected towards the cavities of the motor as indicated by the arrows in FIGS. 7 and 8. A minimal amount of fluid, or no fluid, passes through passage 22. Consequently the flow rate of drilling fluid through the motor increases, thereby activating the motor or increasing the rotation and the torque of the motor.

The ball 15 or other blocking implement can be manufactured of a breakable material, such as Teflon®. When the ball 15 is in place as in FIG. 7 and the motor is active, the motor can be substantially stopped or slowed down by dropping a fracture implement (not shown), such as a smaller stainless steel ball, to shatter to the ball 15. The fragments of the ball 15 can be flushed out of the catch 30 and rotor passage 22 by the drilling fluid. If the fracture implement has a smaller diameter than the passage 35 and bore 22, it will pass through the motor assembly 100 without substantially blocking fluid flow therethrough.

Figure 9:
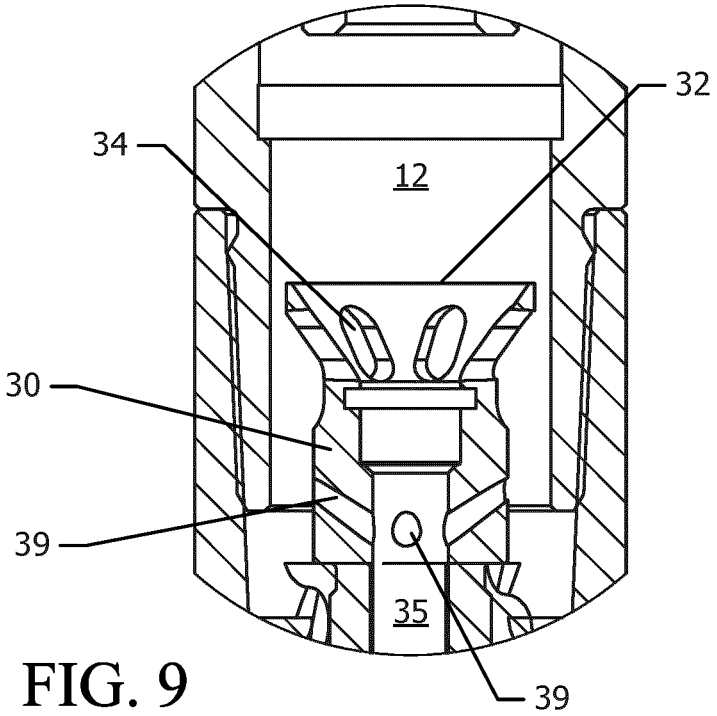
FIGS. 9 and 10 are sectional views of the downhole assembly of FIG. 1 with an alternative catch configuration.
Figure 10:
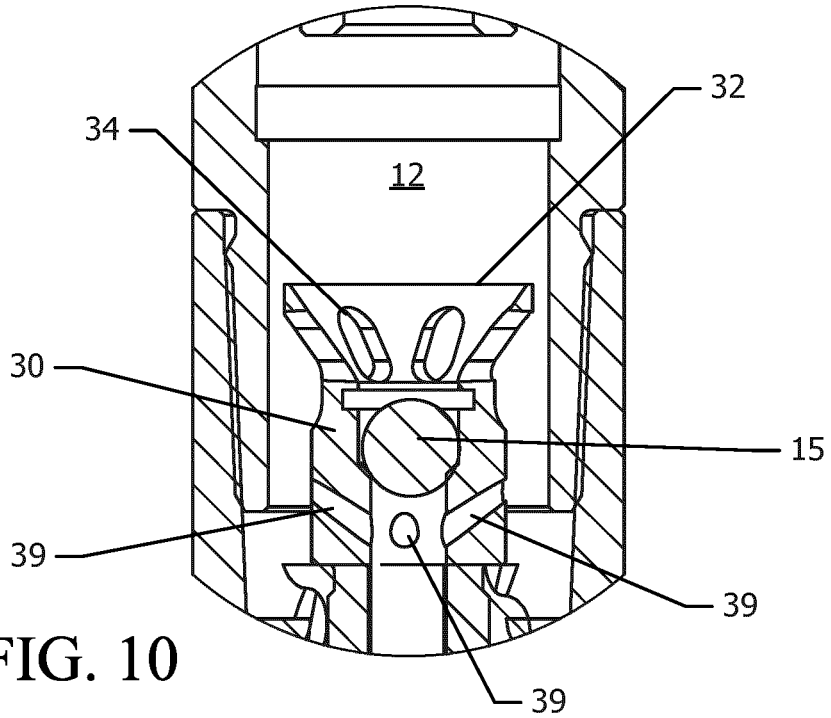

In some implementations, a further bypass may be included in the catch 30, as illustrated in FIGS. 9 and 10. In this example, one or more bypass ports 39 are included below the receiving end 32, proximate to but above the motor cavities. Thus, even when a ball 15 is seated in the catch 30 as in FIG. 10, some fluid can still bypass the motor cavities, thus permitting the motor to run at a lower rate of rotation.

Figure 11:
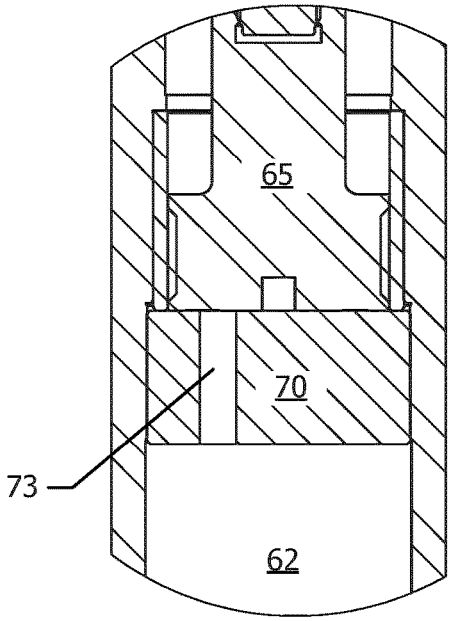
FIG. 11 is a further sectional view of the downhole assembly of FIG. 1.
Figure 12:
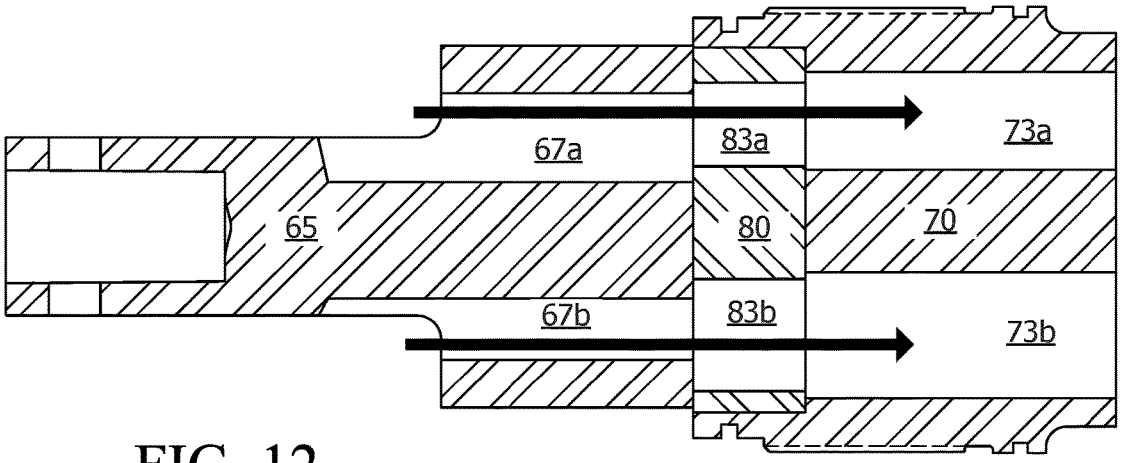
FIGS. 12-13 are lateral cross-sectional views of a rotating valve assembly that may be used with the downhole assembly.
Figure 13:
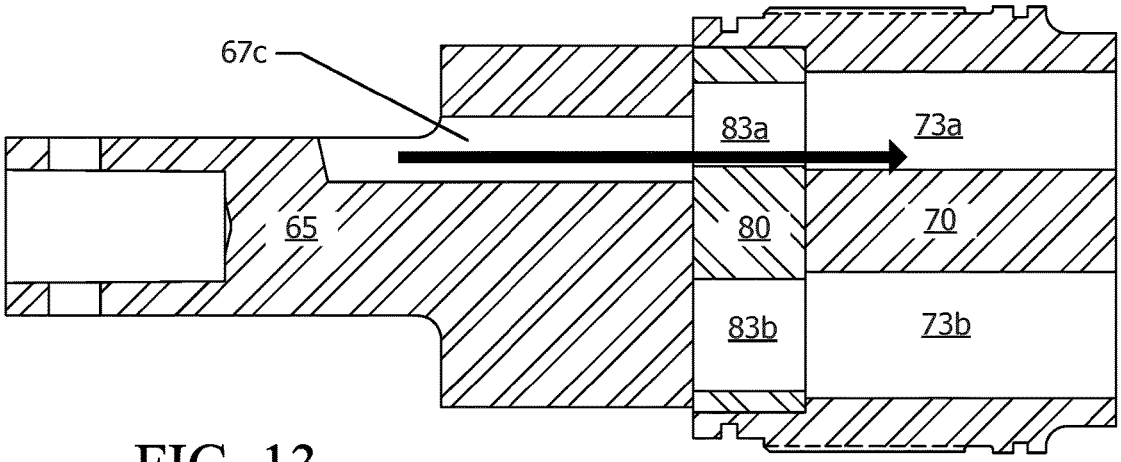

When the rotor assembly and motor is used in a friction tool, such as the example downhole assembly 10 illustrated in FIG. 1, the vibrations created by the friction tool are produced by the oscillation assembly component 13 due to variations in fluid pressure. The variations in fluid pressure can be generated by any suitable component driven by the rotor 25. In the assembly 10, the valve assembly 65-70 generates these variations. With reference to FIGS. 11, 12, and 13, each of the stationary valve component 70 and rotating valve component 65 include one or more ports 73*a*, 73*b*, etc. and 67*a*, 67*b*, 67*c*, etc., respectively. These ports may be arranged regularly or irregularly within their respective component, and may be identically or differently sized.

The rotating valve component 65 is connected to the rotor 25. When the motor is inactive, the rotating valve component 65 is substantially stationary, and fluid flows through the valve components 65, 70 to the extent permitted by the alignment of the ports of the two valve components 65, 70. When the motor is active, the rotating valve component 65 is driven by the rotor 25 and the ports 67*a*, 67*b*, 67*c*, etc. of the rotating valve component move into and out of alignment with the ports 73*a*, 73*b*, etc. of the stationary valve component 70. In the examples shown in the figures, an optional further wear component 80 with ports 83*a*, 83*b* corresponding to the ports of the stationary valve component 70 is included. As can be seen in FIGS. 12 and 13, depending on the relative position of the rotating valve component 65 to the stationary valve component 70, the fluid flow through the valve assembly can be restricted, or even blocked altogether. The intermittent alignment and non-alignment of the valve components 65 and 70 as the rotating valve component 65 rotates create variations in the fluid flow rate, and consequently variations in fluid pressure in the downhole assembly. The variations may be cyclical and repeating, or may be substantially arrhythmic, depending on the selected arrangement and sizing of the ports in the various components 65, 70 (and optionally wear component 80), and the pattern of rotation of the rotating valve component 65 produced by the rotor 25. These variations in fluid pressure activate the oscillation assembly 13, thereby inducing vibrations in the portion of the drilling string containing the downhole assembly 10.

As mentioned above, prior art friction tools or other tools are often driven by the flow of the drilling fluid. Consequently, control of the tool is accomplished by controlling the flow rate and pressure of drilling fluid into the tool; the tool may accordingly be stopped by halting the flow of drilling fluid. However, when drilling fluid is also required to operate the motor, it may be undesirable to simply stop pumping fluid downhole; this may halt the tool, but it will also halt the motor. For these reasons, with prior art friction tools, it is often necessary to halt drilling operations, pull the drilling string to the surface, disassemble the string, and reassemble the string to remove or add the tool, as the case may be. This activity can consume several hours of labour. Those skilled in the art will appreciate that with a downhole friction tool assembly 10 including the rotor assembly described above (i.e., the rotor 25 with integral passage 22 and catch 30), the drilling string including the downhole assembly 10 can be lowered into the well bore and drilling fluid can be pumped into the downhole assembly without engaging the catch 30 and activating the friction tool, until the operator chooses to activate the motor by dropping a ball or other blocking implement into the catch 30. In other words, the motor can be transitioned from an inactive to an active state while drilling fluid is flowing down the string without substantially varying the flow of drilling fluid entering the downhole assembly, and without pulling the drilling string to surface to add in a friction tool.

Figure 14:
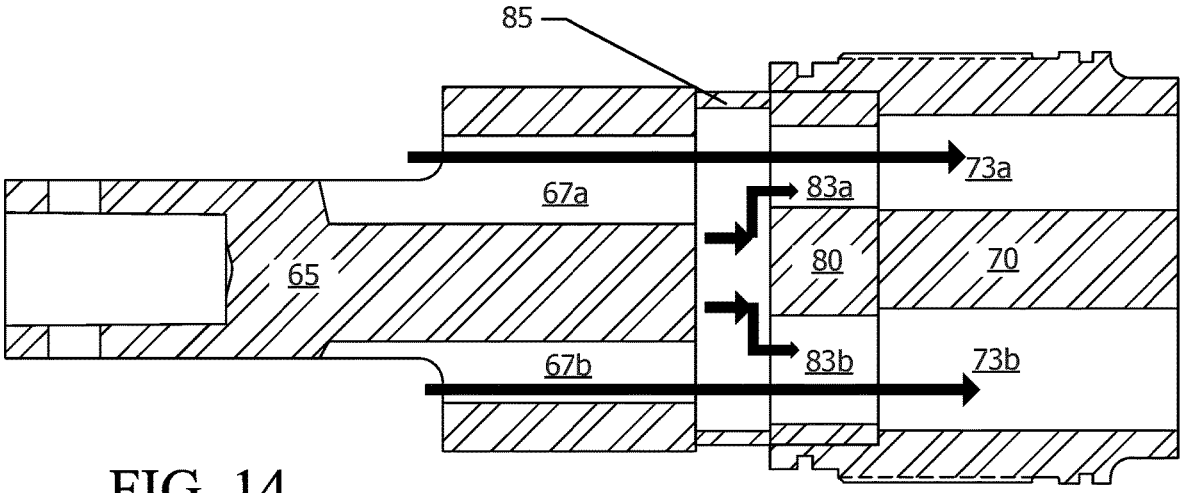
FIGS. 14-15 are lateral cross-sectional views of a variant of the rotating valve assembly of FIGS. 12-13.
Figure 15:
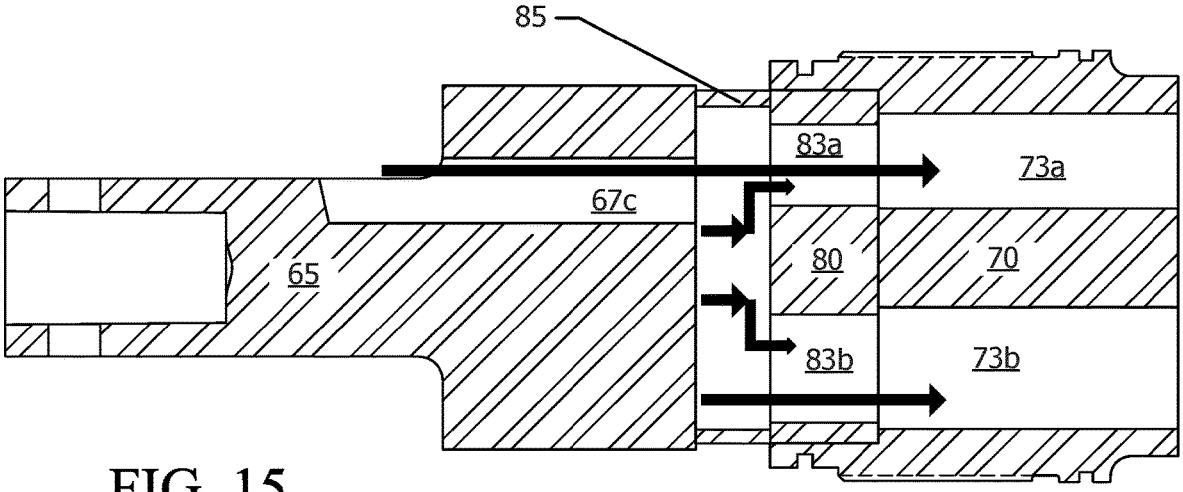

It will be appreciated that in some implementations, when the valve assembly is at rest with the rotating valve component 65 relatively stationary with respect to the stationary component 70, the ports of these components may be aligned in a manner that substantially restricts or blocks drilling fluid flow through the valve assembly and down to other lower portions of the drilling string. It may also or alternatively be desirable to delay the pressure-varying effect of the valve assembly even when the motor is active. Thus, in some embodiments, a temporary spacer ring 85 is included in the valve assembly, as shown in FIGS. 14 and 15, to temporarily permit drilling fluid flow though the valve assembly regardless of the relative orientation of the rotating valve component 65 to the stationary component 70. The temporary spacer ring 85 separates the two valve components 65, 70, supporting the rotating valve component 65 above the stationary valve component 70. Because the components 65, 70 are separated, all the fluid passing through the ports 67*a*, 67*b*, 67*c* of the rotating valve component 65 can enter the ports 73*a*, 73*b* of the stationary valve component 70 without the intermittent restrictions caused by the ports entering into and out of alignment with each other, and without causing substantial variations in fluid pressure. The spacer ring 85 is manufactured of a material such as aluminum, brass, bronze, cement, and the like, that can break down as the rotating valve component 65 rotates against the spacer ring 85. The valve components 70, 65 are typically manufactured of a high strength carbide material that reaches high temperatures during operation.

While the motor of the downhole assembly 10 is inactive, drilling fluid can flow through the passage 22 of the rotor 25, and down to the valve assembly where it will pass through the ports of the rotating valve component 65, the space defined by the spacer ring, and the ports of the stationary valve component 70, without restriction caused by interference of the rotating valve component 65 with the ports of the stationary valve component 70 or vice versa. When the motor of the drilling assembly is activated as described above, the rotor 25 begins driving the rotating valve component 65. The component 65 rotates against the spacer ring 85 within the valve housing and begins to generate heat and friction against the spacer ring, which will wear down the spacer ring 85. The worn portions of the spacer ring 85 will be flushed by the drilling fluid through the stationary valve component 70, until the spacer ring 85 is effectively destroyed and no longer separates the stationary valve component 70 from the rotating valve component 65. At that stage, the valve assembly operates as originally intended to intermittently restrict fluid flow and vary fluid pressure. By selecting the material and depth of the spacing ring 85, the valve assembly and any tool driven by the valve assembly can be selectively disabled for a desired period of time during initial drilling operations. The spacer ring 85 may be used without the catch 30 described above.

Throughout the specification, terms such as "may" and "can" are used interchangeably and use of any particular term should not be construed as limiting the scope or requiring experimentation to implement the claimed subject matter or embodiments described herein. Various embodiments of the present invention or inventions having been thus described in detail by way of example, it will be apparent to those skilled in the art that variations and modifications may be made without departing from the invention(s). The inventions contemplated herein are not intended to be limited to the specific examples set out in this description. For example, where appropriate, specific components may be arranged in a different order than set out in these examples, or even omitted or substituted. The inventions include all such variations and modifications as fall within the scope of the appended claims.

The invention claimed is:

1. A downhole assembly for use in a drilling string, the downhole assembly comprising:

a motor assembly comprising a stator and a rotor assembly, the rotor assembly comprising:

a rotor body having a fluid passage extending between an inlet and an outlet, the fluid passage extending through at least part of the length of the rotor; and a catch component provided on the rotor body, the catch component comprising a receiving end and an interior seat for receiving and retaining a blocking implement, and a fluid passage permitting flow of drilling fluid entering the receiving end to the fluid passage of the rotor body when no blocking implement is retained in the rotor assembly, the receiving end permitting flow around the catch component and into the motor to thereby activate the motor when the blocking implement is retained in the rotor assembly, wherein the receiving end is substantially funnel-shaped and comprises at least one aperture permitting drilling fluid flow from an interior of the receiving end to an exterior of the catch component.

2. The downhole assembly of claim 1, further comprising a further downhole assembly component connected to an end of the rotor body.

3. The downhole assembly of claim 2, wherein the outlet is positioned above a connection of the further downhole assembly component to the rotor body, such that drilling fluid entering the receiving end of the catch component passes through the fluid passage of the rotor body and exits the outlet when no blocking implement is retained in the rotor assembly.

4. The downhole assembly of claim 1, wherein the rotor body comprises a plurality of the outlets, the fluid passage extending between the inlet and the plurality of the outlets.

5. The downhole assembly of claim 1, wherein the catch component and the rotor body are formed as a single piece.

6. The downhole assembly of claim 1, wherein the catch component comprises a connection end opposite the receiving end, the connection end being received at the inlet of the rotor body.

7. A rotor assembly for use in a drilling string, the downhole assembly comprising:

a rotor body having a fluid passage extending between an inlet and an outlet, the fluid passage extending through at least part of the length of the rotor; and a catch component provided on the rotor body, the catch component comprising a receiving end and an interior seat for receiving and retaining a blocking implement, and a fluid passage permitting flow of drilling fluid entering the receiving end to the fluid passage of the rotor body when no blocking implement is retained in the rotor assembly, the receiving end permitting flow around the catch component when the blocking implement is retained in the rotor assembly, wherein the receiving end is substantially funnel-shaped and comprises at least one aperture permitting drilling fluid flow from an interior of the receiving end to an exterior of the catch component.

8. The rotor assembly of claim 7, being adapted at an end to connect to a further downhole assembly component.

9. The rotor assembly of claim 8, wherein the outlet is positioned above a connection of the further downhole assembly component to the rotor body, such that drilling fluid entering the receiving end of the catch component passes through the fluid passage of the rotor body and exits the outlet when no blocking implement is retained in the rotor assembly.

10. The rotor assembly of claim 7, wherein the rotor body comprises a plurality of the outlets, the fluid passage extending between the inlet and the plurality of the outlets.

11. The rotor assembly of claim 7, wherein the catch component and the rotor body are formed as a single piece.

12. The rotor assembly of claim 7, wherein the catch component comprises a connection end opposite the receiving end, the connection end being received at the inlet of the rotor body.

13. A method of activating a motor assembly in a drilling string, the method comprising:

providing in the drilling string a motor, the motor comprising a stator and a rotor assembly, the rotor assembly comprising:

a rotor body having a fluid passage extending between an inlet and an outlet, the fluid passage extending through at least part of the length of the rotor; and a catch component provided on the rotor body, the catch component comprising a receiving end and an interior seat for receiving and retaining a blocking implement, and a fluid passage permitting flow of drilling fluid entering the receiving end to the fluid passage of the rotor body when no blocking implement is retained in the rotor assembly, the receiving end permitting flow around the catch component when the blocking implement is retained in the rotor assembly, while no blocking implement is retained in the rotor assembly, introducing drilling fluid into the drilling string such that a substantial part of the drilling fluid enters the receiving end of the catch component and passes through the fluid passage of the rotor body and exits through the outlet, the substantial part of the drilling fluid thereby bypassing the motor;

positioning the blocking implement in the rotor assembly such that the blocking implement is retained on the interior seat of the catch component so as to substantially block drilling fluid flow through the fluid passage of the rotor body, the blocked drilling fluid being thereby redirected around the catch component and into the motor to thereby activate the motor; and impacting the blocking implement with a fracture implement to fragment the blocking implement and unblock the fluid passage of the rotor body.

* * * * *